United States Patent [19]

Rothrock et al.

[11] 4,261,931

[45] Apr. 14, 1981

[54] COOLING TOWER WITH FLUTED WALL

[75] Inventors: Elmer W. Rothrock, Hinsdale; Clarence D. Miller, Naperville, both of Ill.

[73] Assignee: Chicago Bridge & Iron Company, Oak Brook, Ill.

[21] Appl. No.: 63,204

[22] Filed: Aug. 3, 1979

[51] Int. Cl.[3] ..... B01F 3/04

[52] U.S. Cl. ..... 261/109; 52/247; 261/111; 261/DIG. 11

[58] Field of Search ..... 261/108–112, 261/DIG. 11; 165/DIG. 1; 52/62, 73, 63, 80, 83, 224, 246, 248, 249, 450–453, 618, 620, 630, 625, 671, 674, 245, 247, 629, 148, 244, 336, 675

[56] References Cited

U.S. PATENT DOCUMENTS

| | | | |
|---|---|---|---|
| 1,190,507 | 7/1916 | Bramer | 52/245 |
| 1,191,141 | 7/1916 | Allsteadt | 52/245 X |
| 1,453,806 | 5/1923 | Nord | 52/245 X |
| 2,691,959 | 10/1954 | Dueringer et al. | 52/247 X |
| 3,014,559 | 12/1961 | Rogers | 52/245 |
| 3,300,942 | 1/1967 | Horstman | 261/DIG. 11 |
| 3,395,515 | 8/1968 | Murray | 261/DIG. 11 |
| 3,618,277 | 11/1971 | Waters | 52/245 X |
| 3,648,990 | 3/1972 | Stoker et al. | 261/DIG. 11 |
| 3,732,654 | 5/1973 | Tsurumi | 52/247 X |
| 3,761,067 | 9/1973 | Marosi et al. | 52/245 X |
| 3,994,108 | 11/1976 | Johnson | 261/DIG. 11 |
| 4,010,580 | 3/1977 | Mayr et al. | 261/DIG. 11 |
| 4,060,575 | 11/1977 | Uhlirsch et al. | 261/DIG. 11 |
| 4,092,811 | 6/1978 | Lin et al. | 261/DIG. 11 |

*Primary Examiner*—Richard L. Chiesa

*Attorney, Agent, or Firm*—Merriam, Marshall & Bicknell

[57] ABSTRACT

A cooling tower self-supporting vertical shell essentially circular in horizontal section and wider at the base than at the top, said shell comprising a series of courses set one above the other with each adjacent upper course supported by the course beneath it, most of the courses from at least near the bottom to the shell top portion constituting a frusto-conical shell with vertical flutes, and the diameter of the bottom of each course being about equal to the diameter of the top of the course beneath it.

11 Claims, 9 Drawing Figures

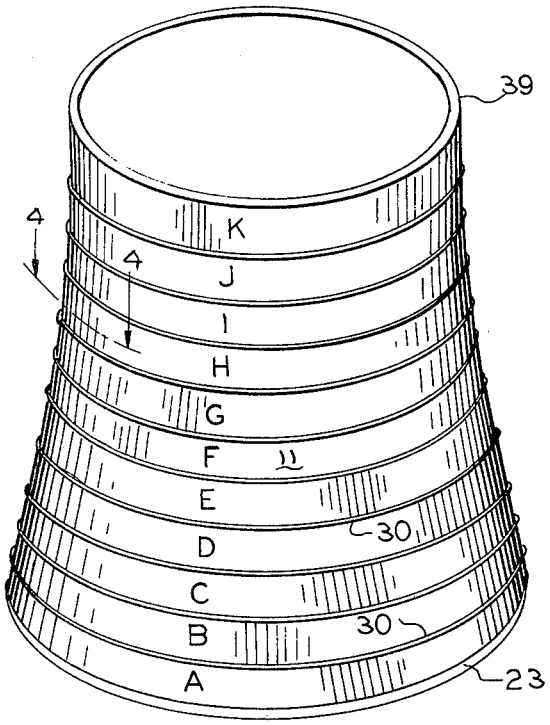
FIG.1
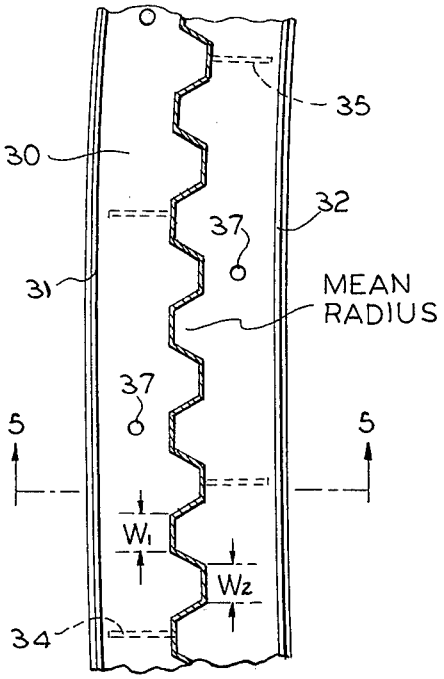
FIG.4
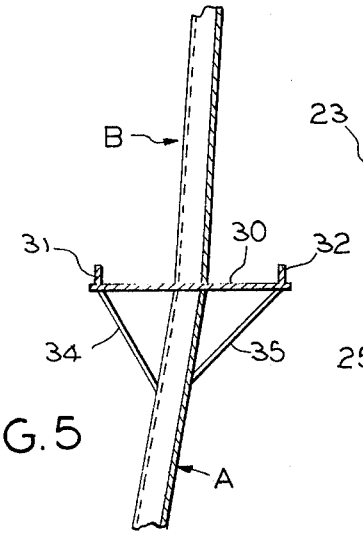
FIG.5
FIG.6
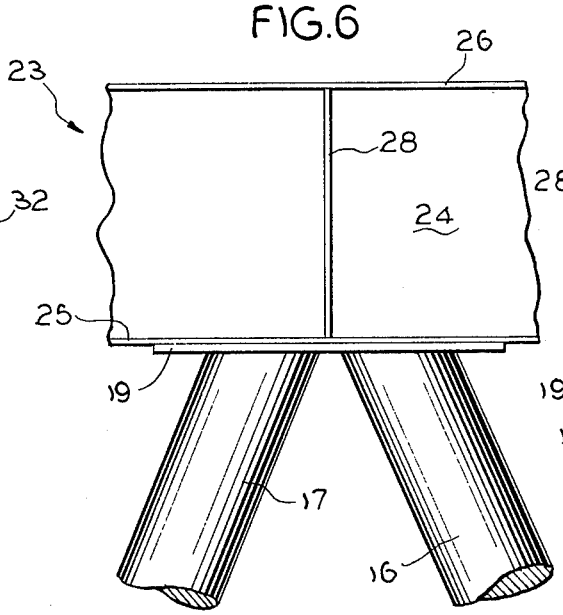
FIG.7
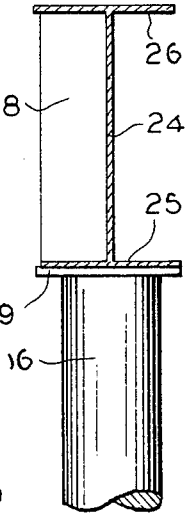

COOLING TOWER WITH FLUTED WALL

This invention relates to cooling towers. More particularly, this invention is concerned with a novel cooling tower shell made of metal.

Electric power generating plants which use a fossil fuel or a nuclear reaction use the heat produced to convert water to steam which is then used to drive a turbine. The resulting spent steam is condensed by indirect heat exchange with a cooling liquid. The cooling liquid is thereby heated and must either be disposed of or cooled for reuse.

The most widely used cooling liquid is water. In the past, it has been customary to dispose of the hot cooling liquid by feeding it to a river or lake. This is no longer possible if the likely result is to create an ecological imbalance by raising the river or lake temperature too high. Accordingly, the hot cooling water must be cooled before it is disposed of or before it is circulated for reuse.

A conventional way of cooling hot cooling water is by heat rejection to air. This requires a flow of a large volume of air in indirect or direct heat exchange with the hot cooling water. One of the most practical and efficient ways to effect such heat exchange is by means of a cooling tower, such as one having a hyperbolically shaped shell and an open shell-supporting grillwork at the bottom. Air flows upwardly through the tower propelled by natural or forced draft. The hot water is sprayed downwardly in the tower for direct heat exchange, or it is passed through heat exchangers in the tower.

There has been considerable interest in replacing water with a refrigerant as the cooling liquid in a closed loop refrigeration cycle. The liquid refrigerant, by condensing the spent steam from the turbine, is vaporized and then conveyed to heat exchangers in a cooling tower where it is condensed, thus rejecting heat to the air in the process. Such a dry cooling cycle has substantial promise because it avoids reliance on the consumptive use of water which is in limited supply.

Large size cooling tower shells, generally hyperbolically shaped, customarily have been made of reinforced concrete. Construction of concrete cooling tower shells is time consuming and requires nearly all field work because of the forms which must be built, positioned and removed, reinforcing materials installed and concrete cast in place. Weather conditions also limit the construction time available for concrete tower construction.

Cooling towers have also been built with a skeletal structural steel frame to which are attached light gauge plain or corrugated sheets. The sheets serve only as a skin or cover and are not essential for support. Fabricating and erecting a metal skeletal frame is costly and time consuming, as is the subsequent installation of the metal skin or cover.

There has been a need, accordingly, for a cooling tower self-supporting metal shell of such shape and design as to minimize the amount and cost of materials used, and which employs shop fabrication of major components and field erection of large subunits for the shell.

According to the present invention, there is provided a cooling tower self-supporting vertical shell essentially circular in horizontal section and wider at the base than at the top, with the shell comprising a series of metal courses set one above the other with each adjacent upper course supported by the course beneath it, each of the courses from at least near the bottom to the shell top portion constituting a frusto-conical shell with vertical flutes, and with the diameter of the bottom of each course being about equal to the diameter of the top of the course beneath it. The vertical flutes increase the buckling resistance of the shell.

Each course is desirably made of metal plate of the same thickness to simplify construction. However, one or more of the courses in the lower portion of the shell can be made of metal plate thicker than the metal plate in courses up higher in the shell. The courses may also be formed of a rigid polymeric material, which desirably may contain internal reinforcement such as glass fibers or wires.

Metal flutes are readily formed by appropriately bending or corrugating flat metal plate to produce vertical flutes of the desired size and shape. Because all, or nearly all, of the courses are frusto-conical shells, it is advantageous to taper parts of some of the flutes. Thus, the bottom, or valley, surface of each flute, or spaced-apart flutes, can be tapered from the bottom to the top of a course. Alternatively, the top, or land, surface, of or between each flute, or spaced-apart flutes, can be tapered from the bottom to the top of a course. In addition, it is also feasible to taper both the bottoms and tops of each flute, or spaced-apart flutes.

The number of flutes in each course can vary or the number can be the same. In general, the tower shell desirably contains at least two adjoining courses having the same number of flutes.

For ease of fabrication, it is advisable for the slant height of the courses to be the same, or approximately the same, as that of the other courses.

Although most of the courses are frusto-conical shells, most of the frusto-conical shells are from dissimilar cones of revolution, whether the slant height of the frusto-conical shells is the same or different. Thus, the angle from the horizontal to an element of a frusto-conical shell incrementally increases, in most instances, from one course to the next higher course from at or near the bottom, to about from the center to the upper portion, of the tower shell, until the angle is nearly 90°. When the angle is 90°, the course, or courses, are cylindrical shells. Courses can also be included in the top portion of the tower shell having the described angle greater than 90° and if such courses are included the top of the tower shell will appear outwardly flared. Even if outwardly flared or frusto-conical shells are not included at the top, the tower shell can be regarded as broadly hyperbolic in vertical section or profile.

Another structural feature which can be advantageously used in combination with the fluted courses is a substantially horizontal flat ring on top of and joined to the upper edge of each course. The lower edge of each upper course is set on, and joined to, the top of the ring. Rings as described serve to facilitate uniting the course ends and they also function as tower shell stiffeners against wind loads.

The novel metal cooling tower shell provided by the invention is desirably supported above ground level, or a foundation, by an open network or grillwork support means through which air can flow into the tower shell.

The invention will be described further in conjunction with the attached drawings, in which:

FIG. 1 is an isometric view of a cooling tower metal shell provided by the invention;

FIG. 4 is a sectional view taken along the line 4—4 of FIG. 1;

FIG. 5 is a sectional view taken along the line 5—5 of FIG. 4;

FIG. 6 is an elevational view of the top portion of the grillwork and tower metal shell supporting beam;

FIG. 7 is a lateral sectional view of the top portion of the grillwork shown in FIG. 6;

So far as is practical, the same or similar elements or parts which appear in the various views of the drawings will be identified by the same numbers.

Figure 2:
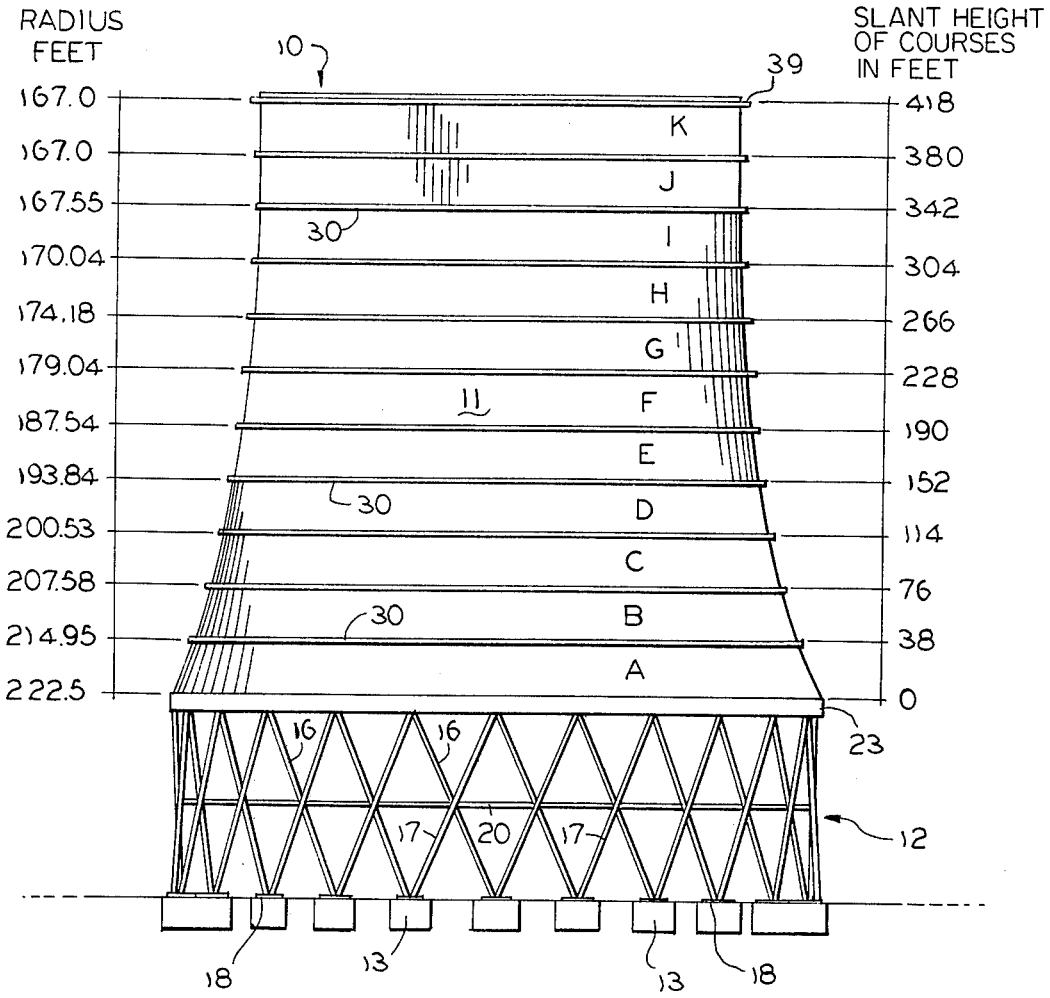
FIG. 2 is an elevational view of the cooling tower shell of FIG. 1, supported by a grillwork.
Figure 3:
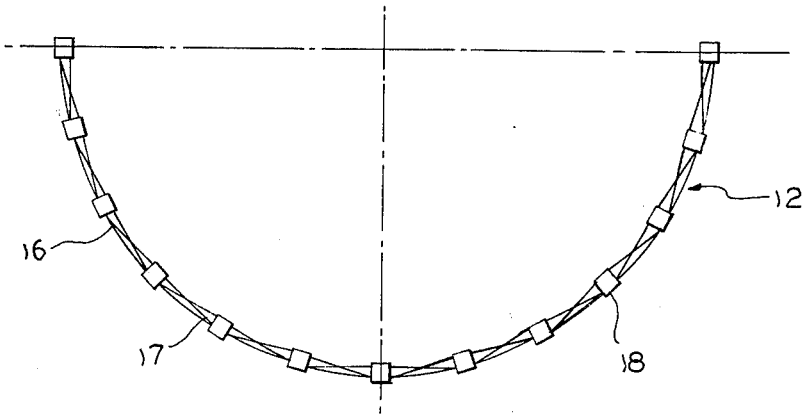
FIG. 3 is a partial plan view of the grillwork and foundation arrangement for the cooling tower shown in FIG. 2.

With reference to FIGS. 1 to 3, the cooling tower 10 has a tower metal shell 11 on grillwork 12 supported on foundation piers 13. Twenty-four piers fifteen feet apart in a 445 foot circle can be used. Extending upwardly at an angle of about 23° from vertical are tubular legs 16 angled to the left and similar legs 17 angled to the right. The lower ends of the legs are joined to base plates 18 mounted on the piers 13. Each pair of legs 16 and 17 is connected at the bottom to every other pier and at the top to a bearing plate 19 (FIGS. 6 and 7). Horizontal tubular member 20, in the form of a ring, reinforces the legs 16 and 17 and joins them at their area of intersection.

Mounted on top of bearing plates 18 is circular girder or beam 23 having a vertical web 24, about seven feet high, a bottom flange 25 and a top flange 26. Spaced-apart vertical lateral plates 28 are joined to web 24 and flanges 25 and 26 to stiffen the girder. The web 26 is about 143 feet above base plates 18.

The cooling tower metal shell 11, shown in FIGS. 1 and 2, is supported on top of girder 23. The metal shell 11 is fabricated of eleven courses, A to K, having vertical flutes. Each course is a frusto-conical shell except the shell of the top course K. The angle from the horizontal to the element of each frusto-conical shell, starting with the lower course, incrementally increases with each upward course until the top course K, which is cylindrical and the angle is 90°. Even though frusto-conical shell angles for the courses can change as described, the slant height of each course can be maintained the same so that metal plates of the same length can be used to fabricate each course.

As is shown in FIGS. 4 and 5, horizontal metal ring plate 30, about 5.5 feet wide, is mounted on the top edge of course A. The lower edge of course B is joined to the top of plate 30. Vertical flanges 31 and 32 are located along the top inner and outer edges of plate 30 to stiffen it. Steel angle braces 34 and 35 are provided to further support plate 30. Drain holes 37 in plate 30 permit water from accumulating on the top of the plate. It should be understood that a similar plate 30 is placed between the adjacent ends of consecutively positioned courses. Although the plates 30 may not be essential in practicing the invention, they are desirably used since they provide a ready means for joining the adjacent ends of courses together, and because they serve to stiffen the cooling tower shell.

A wind girder 39, for example one about 9 feet wide, can be provided on the top of the upper course K to reinforce it against deformation by wind loads.

Figure 8:
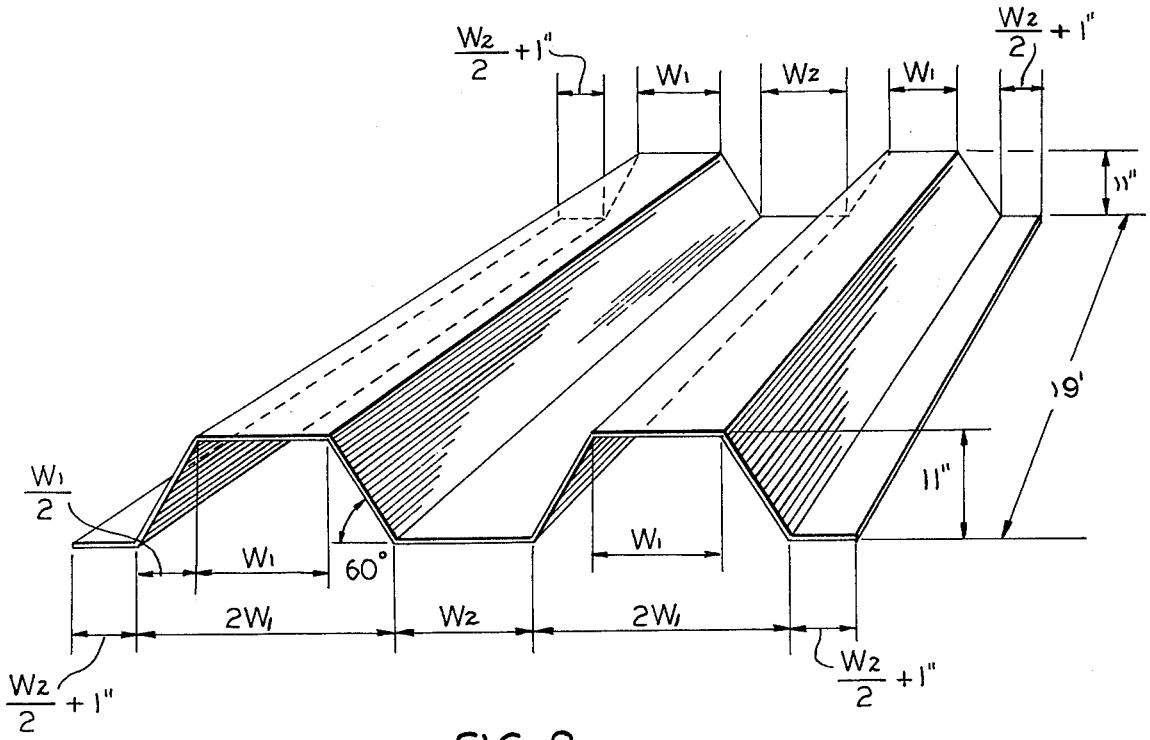
FIG. 8 is an isometric view of a fluted panel used in fabricating a tower shell course.

FIG. 8 illustrates one type of fluted plate design which can be used to produce the frusto-conical shell courses. The fluted plate shown in this figure can be formed on a press brake using plates 9 feet wide and 19 feet long. Each frusto-conical shell course is to be two such plates long with the plates joined by a suitable butt weld. The slant height of each course is thus 38 feet. Each course is to use 220 plates and to have 440 flutes. Course A can be made of 7/32" Corten steel plate and the other courses can be made of 3/16" Corten steel plate. The same steel can be used for other parts of the tower shell. The specific dimensions of the flutes in the various courses at increasing slant height of the cooling tower shell are set forth in the following Table 1, which should be considered in conjunction with FIG. 2, for ease of understanding, since that figure correlates the slant height of courses and radius dimensions with those in the table.

The data in Table 1 shows that the tops or lands of the flutes in courses A to E all have the same $W_1$ value of 12.70 in. The bottoms of the flutes, however, in those courses are tapered, as is shown by the $W_2$ dimensions. Furthermore, the tops or lands of the flutes in courses F to K similarly have the same $W_1$ value of 10.71 while the bottoms of those flutes are tapered as shown by the decreasing dimensions of $W_2$. Panels having the dimensions given in Table 1, furthermore, are intended to have a one inch overlap welded joint along the longitudinal edge of adjacent panels.

It would be obvious, according to the invention, to taper the lands instead of the bottoms of the flutes, or to taper both the flute bottoms or valleys, and tops or lands.

The described cooling tower shell will permit shaping the panels in the shop and assembly of them into subunits, which can then be transported to the erection site for ground assembly into sections of twelve plates. This will reduce the amount of high elevation work compared with concrete tower construction, affording sizable savings in both time and expense.

TABLE 1

| Tower Shell Course | Slant Height of Courses in Feet | Radius in Feet | Plate Dimensions in Inches | | | |
|---|---|---|---|---|---|---|
| | | | $W_1$ | $W_1/2$ | $W_2$ | $W_2/2$ |
| | 0 | 222.5 | 12.70 | 6.35 | 12.70 | 6.35 |
| A | 19 | 218.73 | 12.70 | 6.35 | 12.07 | 6.03 |
| | 38 | 214.95 | 12.70 | 6.35 | 11.44 | 5.72 |
| B | 57 | 211.27 | 12.70 | 6.35 | 10.80 | 5.40 |
| | 76 | 207.58 | 12.70 | 6.35 | 10.17 | 5.09 |
| C | 95 | 204.06 | 12.70 | 6.35 | 9.57 | 4.79 |
| | 114 | 200.53 | 12.70 | 6.35 | 8.96 | 4.48 |
| D | 133 | 197.19 | 12.70 | 6.35 | 8.39 | 4.19 |
| | 152 | 193.84 | 12.70 | 6.35 | 7.82 | 3.91 |
| E | 171 | 190.69 | 12.70 | 6.35 | 7.28 | 3.64 |
| | 190 | 187.54 | 12.70 | 6.35 | 6.74 | 3.37 |
| | 190 | 184.62 | 10.71 | 5.35 | 10.71 | 5.35 |
| F | 209 | 181.69 | 10.71 | 5.35 | 10.21 | 5.10 |
| | 228 | 179.04 | 10.71 | 5.35 | 9.72 | 4.86 |
| G | 247 | 176.38 | 10.71 | 5.35 | 9.26 | 4.63 |
| | 266 | 174.18 | 10.71 | 5.35 | 8.80 | 4.40 |
| H | 285 | 171.98 | 10.71 | 5.35 | 8.43 | 4.21 |
| | 304 | 170.04 | 10.71 | 5.35 | 8.05 | 4.02 |
| I | 323 | 168.1 | 10.71 | 5.35 | 7.72 | 3.86 |
| | 342 | 167.55 | 10.71 | 5.35 | 7.38 | 3.69 |
| J | 361 | 167.0 | 10.71 | 5.35 | 7.29 | 3.65 |
| | 380 | 167.0 | 10.71 | 5.35 | 7.20 | 3.60 |
| K | | | | | | |

TABLE 1-continued

| Tower Shell Course | Slant Height of Courses in Feet | Radius in Feet | Plate Dimensions in Inches | | | |
|---|---|---|---|---|---|---|
| | | | $W_1$ | $W_1/2$ | $W_2$ | $W_2/2$ |
| | 418 | 167.0 | 10.71 | 5.35 | 7.20 | 3.60 |

Figure 9:
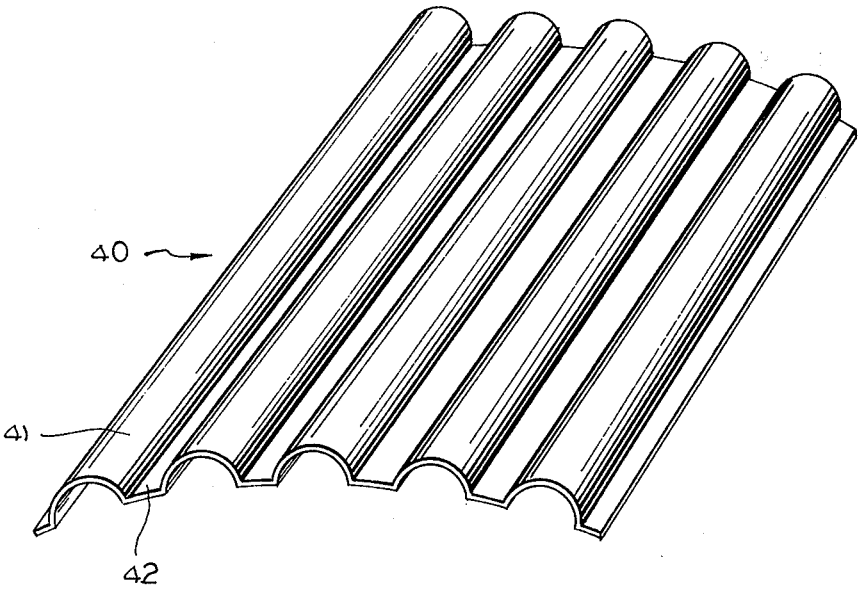
FIG. 9 is an isometric view of a second type of fluted panel which can be used in fabricating a tower shell course.

FIG. 9 illustrates another type of fluted plate which can be used in fabricating a cooling tower metal shell according to the invention. The metal plate 40 shown in this figure has convex flutes 41 and flat trough-like longitudinal areas 42 between the flutes. Either or both of the convex flutes and the flat areas 42 can be tapered from one end of the plate to the other. A similar plate, of course, can be produced by making the flutes 41 concave.

As is clear from the above description, the cooling tower shell provided by this invention is self-supporting and requires no structural skeleton. Loads which the cooling tower shell is designed to resist are the dead weight, wind and a small external pressure differential which is the driving force for natural draft of air in the shell. The dead weight produces an axial compression stress in the shell. The wind produces an overturning moment load, resulting in an axial compression and a diametrically opposed tension superimposed on the dead weight axial stress.

The buckling strength to withstand the compressive loads is achieved by the combination of the flutes acting as columns, with elastic lateral restraint provided by the horizontal circular rings and the continuous shell. In addition, each flute is sized to be adequate to resist the formation of local buckles. The circular rings 30 are designed to provide lateral restraint for the flutes, to resist buckling or large deformation from the reactions produced by changes in the shell slope, and to resist buckling from the external pressure of the wind and draft.

Although the specific embodiment of the invention described herein has the same number of flutes in each course, it is also feasible to have the same size flutes in each course and to incrementally decrease the number of flutes in each successively higher course. This would permit the same die to be used to flute plates for more than one course.

This detailed description has been given only for clearness of understanding, and no unnecessary limitation should be understood therefrom, as modifications will be obvious to those skilled in the art.

What is claimed is:

1. A cooling tower self-supporting vertical shell, requiring no additional supporting column or cables, essentially circular in horizontal section and wider at the base than at the top, said shell comprising a series of courses set one above the other with each adjacent upper course supported by the course beneath it, most of the courses from at least near the bottom to the shell top portion constituting a frusto-conical shell with vertical flutes sized to be adequate for the shell to resist buckling from its dead weight and external pressure of the wind, and the diameter of the bottom of each course being about equal to the diameter of the top of the course beneath it.

2. A cooling tower shell according to claim 1 in which each course is made of metal plate.

3. A cooling tower self-supporting vertical metal shell, requiring no additional supporting column or cables, essentially circular in horizontal section and wider at the base than at the top, said metal shell comprising a series of metal courses one above the other with the lower edge of upper courses set on, and joined to, a substantially horizontal flat ring on top of and joined to the upper edge of the lower courses, most of the courses from at least near the bottom to the shell top portion constituting a frusto-conical shell, with vertical flutes, said flat rings and vertical flutes being sized to be adequate for the shell to resist buckling from its dead weight and external pressure of the wind, and the diameter of the bottom of each course being about equal to the diameter of the top of the course beneath it.

4. A cooling tower metal shell according to claim 3 in which each individual course is made of metal plate of about the same thickness.

5. A cooling tower metal shell according to claim 3 in which all of the courses are made of metal plate of about the same thickness.

6. A cooling tower metal shell according to claim 3 in which at least part of the flutes taper, and are narrower at the top than at the bottom, in at least some of the courses.

7. A cooling tower metal shell according to claim 3 in which the number of flutes is the same in at least two adjoining courses.

8. A cooling tower metal shell according to claim 3 in which each course has about the same slant height.

9. A cooling tower metal shell according to claim 3 in which the courses comprising about the lower one-half of the shell have a smaller diameter at the top than the diameter at the bottom.

10. A cooling tower metal shell according to claim 3 in which the shell vertical profile is generally hyperbolic.

11. A cooling tower metal shell according to claim 3 in which the bottom is supported above a foundation by an open grillwork support means through which air can flow into the shell.

* * * * *